United States Patent [19]

Eguchi et al.

[11] 4,402,838

[45] Sep. 6, 1983

[54] LUBRICANT COMPOSITIONS FOR FORGING OR EXTRUSION

[75] Inventors: Kiyohisa Eguchi, Kawanishi; Norio Kitamura, Itami; George Ohta, Ikoma; Terumasa Okamura, Kashiwa; Seizi Yamada, Toyohashi, all of Japan

[73] Assignees: Agen. of Ind. Sci. & Tech., Tokyo; Hanano Commercial Co., Kobe; Taihei Chem. Inc., Osaka; Gosei Kagaku KKK., Tokyo, all of Japan

[21] Appl. No.: 301,226

[22] Filed: Sep. 11, 1981

[30] Foreign Application Priority Data

Sep. 19, 1980 [JP] Japan ..... 55-131335

[51] Int. Cl.[3] ..... C10M 1/50

[52] U.S. Cl. ..... 252/28; 252/49.6; 72/42

[58] Field of Search ..... 252/28, 49.6; 72/42; 428/446

[56] References Cited

U.S. PATENT DOCUMENTS 3,840,461 10/1974 Espunes ..... 252/28

4,260,498 4/1981 Sample, Jr. et al. ..... 252/28

*Primary Examiner*—Jacqueline V. Howard

*Attorney, Agent, or Firm*—Armstrong, Nikaido, Marmelstein & Kubovcik

[57] ABSTRACT

A lubricant composition for forging or extrusion comprising a mixture of:

(A) at least one compound selected from among phosphoric acid and salts thereof, (B) at least one compound selected from among boric acid and salts thereof, (C) at least one compound selected from among carbonates, nitrates, sulfates and hydroxides of alkali metals, and (D) a phyllosilicate, the mixture containing the compounds (A) to (C) in amounts, calculated as oxides, of 40 to 44 mole % of $P_2O_5$, up to 9 mole % of $B_2O_3$ and 30 to 60 mole % of $M_2O$ wherein M is an alkali metal, respectively.

4 Claims, No Drawings

LUBRICANT COMPOSITIONS FOR FORGING OR EXTRUSION

This invention relates to lubricant compositions for forging or extrusion.

Lubricants heretofore most widely used for forging and extrusion are mineral oils, mixtures of mineral oils and graphite, and mixtures of graphite and water. Mineral oils are not fully satisfactory in lubricity as well as in the ability to release shaped products from dies (releasability) and have environmental and operation problems in that when used for hot working, such oils give off fumes and involve fire hazards. Mixtures of mineral oils and graphite or mixtures of graphite and water, although improved in lubricity and releasability, have substantially the same environmental and operation problems as encountered with mineral oils.

An object of this invention is to provide lubricants for forging or extrusion which are outstanding both in lubricity and in releasability.

Another object of the invention is to provide lubricants for forging or extrusion which are free of any environmental or operation problem.

These objects and other features of the invention will become apparent from the following description.

The lubricant composition of this invention is characterized in that the composition comprises a mixture of:

(A) at least one compound selected from among phosphoric acid and salts thereof, (B) at least one compound selected from among boric acid and salts thereof, (C) at least one compound selected from among carbonates, nitrates, sulfates and hydroxides of alkali metals, and (D) a phyllosilicate, the mixture containing the compounds (A) to (C) in amounts, calculated as oxides, of 40 to 44 mole % of $P_2O_5$, up to 9 mole % of $B_2O_3$ and 30 to 60 mole % of $M_2O$ wherein M is an alkali metal, respectively.

Our research has revealed that when a phyllosilicate is used conjointly with a water-soluble glass composed of the above-specified compounds (A) to (C) for forging or extrusion, the silicate produces high lubricity at high temperatures, synergistically exhibiting outstanding lubricating properties in combination with the specific water-soluble glass which per se has high lubricity. We have further found that the present composition not only gives full lubricity even to dies of complex shape but also exhibits excellent characteristics almost without producing indentations due to the accumulation of the composition.

The phyllosilicates to be used in this invention have a layer structure and include synthetic silicates and natural silicates. Especially preferable for use in this invention are swelling phyllosilicates including natural silicates such as montmorillonite, and synthetic micas such as those disclosed in Published Examined Japanese Patent Application Nos. 44758/1977, 29320/1978 and 20959/1978. Also usable for this invention are non-swelling silicates although they produce lower lubricity than swelling silicates. Examples of such silicates are micas such as muscovite $[KAl_2(AlSi_3O_{10})(OH)_2]$, paragonite $[NaAl_2(AlSi_3O_{10})(OH)_2]$, phlogopite $[KMg_3(AlSi_3O_{10})(OH)_2]$, biotite $[K(Mg,Fe)_3(AlSi_3O_{10})(OH)_2]$, lepidolite $[KLi_2Al(Si_4O_{10})(OH)_2]$, zinnwaldite $[KLiFeAl(AlSi_3O_{10})(OH)_2]$, magarite $[CaAl_2(Al_2Si_2O_{10})(OH)_2]$, etc., kaolinite, halloysite, illite, pyrophyllite, talc, etc.

The water-soluble glass, the other essential component of the present composition, comprises 40 to 55 mole % of $P_2O_5$, up to 9 mole % of $B_2O_3$ and 30 to 60 mole % of $M_2O$ wherein M is an alkali metal. Preferably the glass comprises 40 to 45 mole % of $P_2O_5$, 3 to 9 mole % of $B_2O_3$ and 45 to 55 mole % of $M_2O$. It is especially preferred that the glass contain 6 to 9 mole % of $B_2O_3$. The glass has a suitable viscosity of several hundred to several thousand poises at a temperature of about 200° to about 800° C. at which it is used for forging or extrusion. If the proportions of $P_2O_5$, $B_2O_3$ and $M_2O$ are outside the foregoing ranges, the glass fails to have a suitable viscosity at 200° to 800° C. and therefore to exhibit high lubricity which is essential to lubricants, hence undesirable.

The water-soluble glass can be prepared from a wide variety of materials which are usually used in the art. Phosphoric acid and primary or secondary phosphates are usable as $P_2O_5$ sources. Examples of useful phosphates are sodium primary phosphate, potassium primary phosphate, sodium metaphosphate, sodium secondary phosphate, potassium secondary phosphate, sodium polyphosphate, potassium polyphosphate, etc. At least one of boric acid and borates is usable as the $B_2O_3$ source. Preferable are alkali metal salts of boric acid, such as sodium borate and potassium borate. Carbonates, nitrates, sulfates and hydroxides of alkali metals are usable as $M_2O$ sources. Examples of preferred alkali metals are sodium and potassium. Examples of useful $M_2O$ sources are sodium carbonate, potassium carbonate, sodium nitrate, potassium nitrate, sodium sulfate, potassium sulfate, sodium hydroxide, potassium hydroxide, etc.

The water-soluble glass is used as it is or as dissolved in water. It is preferable to use the glass as pulverized usually to a mesh lower than minus 100 mesh. For use in the form of an aqueous solution, the water-soluble glass is dissolved in water. The ratio of the glass to water is not particularly limited but widely variable. Usually the aqueous glass solution has a concentration of 2 to 60% by weight, preferably 20 to 50% by weight. The aqueous solution can be prepared easily merely by admixing the water-soluble glass with water and stirring the mixture at room temperature. Usually a concentrated solution is prepared, which is diluted with a suitable amount of water before use. Generally the solution to be used has a concentration of 0.2 to 20% by weight.

According to the invention, a mixture of materials which will form the water-soluble glass is usable in place of the glass. In this case, a material usable as the $P_2O_5$ source, a material serving as the $B_2O_3$ source and a material serving as the $M_2O$ source (such materials will be hereinafter referred to as "source materials") are mixed together in such proportions that the resulting mixture contains 40 to 55 mole % of $P_2O_5$, up to 9 mole % of $B_2O_3$ and 30 to 60 mole % of $M_2O$. The mixture is used at it is or in the form of an aqueous solution. When the mixture or solution is applied to a die heated at about 200° to about 800° C. for forging or extrusion, the mixture is melted by the heat and easily vitrified, or the solution is similarly vitrified on evaporation of the water.

The lubricant compositions of this invention can be classified into four types: a mixture of a silicate and source materials serving as the $P_2O_5$ source, $B_2O_3$ source and $M_2O$ source; a mixture of a suspension of the source materials and a phyllosilicate; a mixture of the water-soluble glass and a silicate; and a suspension of a silicate in an aqueous solution of the water-soluble glass. The ratio of the silicate to the mixture of source materials or to the water-soluble glass is widely variable suitably. For application to dies of simple shape, for example, the ratio is widely variable within such a range that the resulting lubricant composition contains 10 to 60% by weight of the silicate based on the solids. For use with dies of complicated shape, the ratio is so determined that the composition contains about 30 to about 60% by weight, preferably about 30 to about 50% by weight, of the silicate based on the solids. When the amount is less than about 30% by weight in the latter case, the forged or extruded product is likely to have indentations, whereas if it is more than about 60% by weight, lower lubricity and reduced releasability will result.

When the source materials or water-soluble glass and the silicate are used in the form of a powder, it is preferable that the powder have particle sizes approximately of minus 350 mesh. Further when the source materials or water-soluble glass is used in the form of an aqueous solution, the silicate may be admixed directly with the solution, but it is preferable to suspend the silicate in water and then admix the suspension with the solution.

To use the lubricant composition of this invention, the composition is applied to forging or extrusion dies by a suitable method, such as coating, spraying, dusting or immersion. Since the forging or extrusion die is usually heated to about 200° to about 800° C., the composition forms a coating having high lubricity and releasability on evaporation of water when in the form of an aqueous suspension, or on melting when in the form of a powder. Further when used conjointly with the water-soluble glass, the silicate, whether in the form of a powder or an aqueous suspension, exhibits outstanding lubricity and releasability. The reason for this, although still remaining to be fully investigated, is presumably that even if the water present between the leaves of the silicate evaporates off at a high temperature, the specific glass melts and ingresses into the spaces therebetween or that the evaporation of water between the leaves is inhibited by the glass.

The invention will be described in greater detail with reference to the following examples.

EXAMPLE 1

Phosphoric acid, sodium carbonate, potassium primary phosphate and boric acid are mixed together in proportions, calculated as oxides, of 41.2 mole % $P_2O_5$, 7 mole % $B_2O_3$, 39.3 mole % $Na_2O$ and 12.5 mole % $K_2O$, and the mixture is heated at 900° C. for 30 minutes for melting and vitrified. The glass is dissolved in water to obtain an aqueous solution having a concentration of 20% by weight. On the other hand, a synthetic mica ($NaMg_{2.5}Si_4O_{10}F_2$, trade mark "DIMONITE-DM(Na-TS)," product of Topy Industrial Co., Ltd., Japan) is suspended in water to prepare a suspension having a concentration of 10% by weight. Subsequently the aqueous glass solution and the mica suspension are mixed together in the ratios listed in Table 1 to obtain various lubricant compositions.

The lubricant compositions are tested for properties under the following conditions by the method stated below. Table 1 shows the test results.

Test conditions

Forging machine: Drop hammer (25 tons)
Test specimen: Rod
Material heating temperature: 1370°–1380° C.
Working temperature: 1270°–1280° C.
Die temperature: 200° C.
Material: SCM-3 (molybdenum steel)
Dilution of lubricant: 5-fold dilution with water

Test method

The lubricant composition is uniformly applied to the dies with a brush and tested for the adhesion of the forging to the die, indentations in the forging, lubricity and releasability of the forging from the die. These properties are determined according to the following.

Adhesion: Ratio of the forgings adhering to the die.
Indentations: Checked with the unaided eye.
Releasability: The degree of adhesion of the forging to the die perceived by the hand when the forging is removed from the die.

Test results

Given in Table 1.

TABLE 1

| Ratio by wt. of glass/mica in solids | Adhesion | Indentations | Releasability |
|---|---|---|---|
| 100:0 | O | X | O |
| 90:10 | O | X | O |
| 80:20 | O | X | O |
| 70:30 | O | O | O |
| 60:40 | O | O | O |
| 50:50 | O | O | O |
| 40:60 | Δ | O | O |
| 30:70 | Δ | O | Δ |
| 20:80 | X | O | X |
| 10:90 | X | O | X |
| 0:100 | X | O | X |

The properties listed above are evaluated according to the following criteria.
Adhesion
O: At least 90 forgings out of 100 are free of adhesion.
Δ: 85 to 89 forgings out of 100 are free of adhesion.
X: Up to 84 forgings out of 100 are free of adhesion.
Indentations
O: No indentions
X: Indented
Releasability
O: Little or no adhesion
Δ: Slight adhesion
X: High degree of adhesion

EXAMPLE 2

Lubricant compositions are prepared in the same manner as in Example 1 with the exception of using the glass and the synthetic mica in varying ratios and diluting the mixture to varying degrees. The compositions are tested for adhesion of forgings under the following conditions by the method stated below.

Test conditions

Forging machins: Forging press (1600 tons)
Test specimen: Ball nut
Material heating temperature: 1200°–1250° C.
Material: SKD 61 (tool steel alloy)

Test method

The lubricant composition is uniformly applied to the dies with a brush. The number of forgings adhering to the die is determined.

Test results

Given in Table 2.

TABLE 2

| Number of adhering forgings/number of forgings produced | | | | | |
|---|---|---|---|---|---|
| Ration by wt. of glass/mica in solids | Dilution degree (fold) | | | | |
| | Conc. | 2 | 3 | 4 | 5 |
| 20:80 | 3:3 | | | | |
| 30:70 | 4:6 | | | | |
| 40:60 | 4:10 | 2:6 | 2:2 | | |
| 50:50 | 3:20 | 3:10 | 7:10 | | |
| 60:40 | 2:22 | 2:20 | 8:14 | | 8:8 |
| 70:30 | 1:20 | 2:20 | | | 6:10 |
| 80:20 | 2:20 | 1:20 | 6:14 | 10:16 | |
| 90:10 | 3:20 | | 5:8 | | |

EXAMPLE 3

An aqueous solution of glass and an aqueous suspension of phyllosilicate are prepared in the same manner as in Example 1 and mixed together to obtain a lubricant composition containing 5% by weight of glass solids and the same amount of the silicate. The composition is tested under the following conditions.

Test conditions

Forging machine: Forging press (1600 tons)
Test specimen: Link, synchronizing cone
Materials: SKD 61
Material heating temperature: 1200°-1250° C.
Dilution: 5-fold with water
Applicator: Brush Test result The composition releases no fume or oily substance and affords forgings without seizure that occurs when synthetic mica is used singly. The forgings obtained are much superior to those prepared with use of the water-soluble glass only in freedom from indentations due to the accumulation of the lubricant.

EXAMPLE 4

The same water-soluble glass as used in Example 1 is dissolved in water to prepare an aqueous solution having a concentration of 14% by weight. The same synthetic mica as used in Example 1 is suspended in water to obtain an aqueous suspension having a concentration of 6% by weight. The two liquids are mixed together to obtain a lubricant composition containing the glass and the synthetic mica in a ratio by weight of 7:3 and in a combined amount of 10% by weight. The composition is tested under the following conditions.

Test conditions

Forging machine: Forging press (1600 tons)
Test specimen: Ball nut
Material: SKD 61
Material heating temperature: 1200°-1250° C.
Dilution: 5-fold
Applicator: Brush Test result The machine and the operator remain almost free of staining. There is no disturbance in 5000 operating cycles. The dies are free of plastic deformation and abnormal changes in the degree of wear and temperature. The forgings are very satisfactory in respect of quality, indentations, etc.

EXAMPLE 5

The lubricant composition of Example 3 is tested under the following conditions by the method described below.

Test conditions

| | |
|---|---|
| Extruder: | UBE double-acting extruding press (1800 tons, product of Ubekosan Kabushiki Kaisha, Japan) |
| Test specimen: | Tube, 71 mm in O.D. and 60.55 mm in I.D. |
| Material: | Brass (6:4 alloy) |
| Temperature conditions: | |
| Billet: | 840° C. |
| Container sleeve: | About 450° C. outside<br>About 700° C. inside |
| Die: | 650-700° C. |

Test method

When the extrudate is sliced, the composition is manually sprayed to the die end face and bearing portion.

Test result

The operation is carried out free of any trouble.

EXAMPLE 6

An aqueous glass solution is prepared in the same manner as in Example 1. On the other hand, bentonite (as prescribed in the Japanese Pharmacopoeia), minus 350 mesh in particle sizes, is suspended in water to prepare an aqueous suspension having a concentration of 10% by weight. The two liquids are mixed together to obtain a lubricant composition containing the glass and bentonite in a weight ratio of 5:5 in a combined amount of 10% by weight. The composition is tested under the following conditions by the method stated below.

Test conditions

Forging machine: Forging press (1000 tons)
Test specimen: Clutch gear
Material heating temperature: 1200° C.
Working temperature: 1050°-1150° C.
Die temperature: 200°-300° C.
Material: ASCM-17H (special steel)
Dilution: 4-fold with water Test method and result The lubricant composition is uniformly applied to the dies with a brush and checked for performance. The machine and the operator are free of staining. Forgings are obtained free of indentations and without entailing adhesion, wear on the dies, plastic deformation of the dies and abnormal changes in the temperature conditions.

EXAMPLE 7

A lubricant composition is prepared in the same manner as in Example 3 and tested under the following conditions.

Test conditions

Forging machine: Forging press (1600 tons)
Test specimen: Link

Material: SKD 61
Material heating temperature: 1200°–1250° C.
Die temperature: 200°–300° C.
Dilution: 20-fold
Application of composition: Applied to the dies with a brush for every operating cycle Test result Almost the same as is achieved in Example 6.

EXAMPLE 8

A water-soluble glass is prepared in the same manner as in Example 1 and pulverized approximately to minus 100 mesh. On the other hand, the same synthetic mica as used in Example 1 is pulverized approximately to minus 100 mesh. The two powders are mixed together in the same proportions to obtain a lubricant composition, which is tested under the following conditions.

Test conditions

Forging machine: Forging press (1600 tons)
Test specimen: Link
Material: SKD 61
Material heating temperature: 1200°–1250° C.
Die temperature: 200°–300° C.
Application of composition: Applied to the upper and lower dies with a hand spray for every cycle Test result Almost the same as is achieved in Example 6.

EXAMPLE 9

A lubricant composition is prepared in the same manner as in Example 3 except that minus 350-mesh muscovite is used in place of the synthetic mica used in Example 3. The composition is tested under the following conditions.

Test conditions

Forging machine: Forging press (1000 tons)
Test specimen: Clutch gear
Material heating temperature: 1200° C.
Working temperature: 1050°–1150° C.
Die temperature: 200°–300° C.
Material: ASCM-17H
Dilution: 3-fold
Application of composition: Applied to the dies with a brush Test result Almost the same as is achieved in Example 6.

EXAMPLE 10

A lubricant composition is prepared in the same manner as in Example 1 except that $LiMgLi(X_4O_{10})$ wherein X is Si or Ge and $Na_{1/3}Mg_{2\,2/3}Li_{1/3}(Si_4O_{10})F_2$ are used in place of the synthetic mica used in Example 1. An outstanding result comparable to those achieved in Example 1 is attained.

EXAMPLE 11

Phosphoric acid, sodium carbonate, potassium primary phosphate and boric acid are mixed together in proportions, calculated as oxides, of 41.3 mole % $P_2O_5$, 7.0 mole % $B_2O_3$, 30.0 mole % $Na_2O$ and 21.7 mole % $K_2O$, and the mixture is heated at 900° C. for 30 minutes for melting and vitrified. An aqueous suspension containing 10% by weight of solids is prepared from 5 parts of the glass and 5 parts of the same synthetic mica as used in Example 1. The lubricant composition thus prepared is tested for performance under the following conditions by the method stated below.

Test conditions

Extruders: ES 1500A (1500 tons), 6 inches in billet size, and ES 2350A (2350 tons), 8 inches in billet size. Both products of Ubekosan Kabushiki Kaisha, Japan
Test specimen: Aluminum sash
Billet heating temperature: 420°–480° C.
Container temperature: 400°–450° C.
Dummy block temperature: 300°–400° C.
Die temperature: 400°–500° C.
Material: 6063
Dilution: 30-fold with water Test method Before extrusion, the composition is applied to the dummy block by an automatic spray in two directions for 5 to 8 seconds and is also applied to the container end face and shear face (inside surface of the die) by a hand spray for 2 seconds.

Test result

The composition releases no fume or no oily substance, permits no seizure and produces no indentation due to accumulation. Thus the composition exhibits generally satisfactory releasability and lubricity.

We claim:

1. A lubricant composition for forging or extrusion comprising a mixture of:
   (A) at least one compound selected from the group consisting of phosphoric acid and sodium and potassium salts thereof,
   (B) at least one compound selected from the group consisting of boric acid and sodium and potassium salts thereof,
   (C) at least one compound selected from the group consisting of carbonates, nitrates, sulfates and hydroxides of sodium and potassium, and
   (D) a phyllosilicate, the mixture containing the compounds (A) to (C) in amounts, calculated as oxides, of 40 to 44 mole % of $P_2O_5$, up to 9 mole % of $B_2O_3$ and 30 to 60 mole % of $M_2O$ wherein M is an alkali metal, respectively.

2. A lubricant composition as defined in claim 1 wherein the materials (A) to (D) are suspended in water.

3. A lubricant composition for forging or extrusion comprising a phyllosilicate and a water-soluble glass powder containing 40 to 55 mole % of $P_2O_5$, up to 9 mole % of $B_2O_3$ and 30 to 60 mole % of $M_2O$ wherein M is an alkali metal.

4. A lubricant composition for forging or extrusion comprising a phyllosilicate and an aqueous solution of a water-soluble glass containing 40 to 55 mole % of $P_2O_5$, up to 9 mole % of $B_2O_3$ and 30 to 60 mole % of $M_2O$ wherein M is an alkali metal.

* * * * *

UNITED STATES PATENT AND TRADEMARK OFFICE

CERTIFICATE OF CORRECTION

PATENT NO. : 4,402,838

DATED : September 6, 1983

INVENTOR(S) : EGUCHI ET AL

It is certified that error appears in the above-identified patent and that said Letters Patent is hereby corrected as shown below:

In the ABSTRACT, line 12: "44" should read --55--.
Col. 1, line 39: "44" should read --55--.
Col. 8, line 48: "44" should read --55--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*